United States Patent [19]

Goris et al.

[11] Patent Number: 4,674,576

[45] Date of Patent: Jun. 23, 1987

[54] CASING HANGER RUNNING TOOL

[75] Inventors: Gregg A. Goris, Oxnard; John R. Pettit; Raymond L. Rhodes, both of Camarillo, all of Calif.

[73] Assignee: Vetco Gray Inc., Houston, Tex.

[21] Appl. No.: 766,365

[22] Filed: Aug. 16, 1985

[51] Int. Cl.[4] ..... E21B 23/04

[52] U.S. Cl. ..... 166/382; 166/125; 166/182; 166/387

[58] Field of Search ..... 166/123, 124, 125, 181, 166/182, 348, 382, 387

[56] References Cited

U.S. PATENT DOCUMENTS

| | | | |
|---|---|---|---|
| 3,273,646 | 9/1966 | Walker | 166/124 |
| 3,460,615 | 8/1969 | Watkins | 166/208 |
| 3,489,215 | 1/1970 | Regan | 166/208 |
| 3,800,869 | 4/1974 | Herd et al. | 166/382 |
| 4,441,560 | 4/1984 | Baugh et al. | 166/124 |
| 4,565,247 | 1/1986 | Taff et al. | 166/123 |

*Primary Examiner*—Stephen J. Novosad
*Assistant Examiner*—William P. Neuder
*Attorney, Agent, or Firm*—Joseph R. Dwyer

[57] ABSTRACT

A running tool (RT) comprising a stem (10) with a torque ring (44), a running nut (36), an engagement sleeve (40), and a lock ring (42) to releasably connect and support a casing hanger (C), a two piece (16,20) wear bushing (WB) and packoff assembly (P) thereon. The lock ring (42) is wedged into engagement with one piece (16) of the wear bushing (WB) by downward axial movement of the running nut (36). The casing hanger (C) is threaded on the packoff assembly (P) and supported thereby and arranged so that rotation of the torque ring (44) and stem (10) rotates another piece (20) of the wear bushing (24) and the packoff assembly (P) to set the packoff.

The casing hanger (C) and one piece of the wear bushing (WB) are lowered on the running tool (RT) into final position within the wellhead (W). The running tool (RT) is released by rotation of the stem (10) which raises the running nut (36), disengages the engagement sleeve (40), allowing the lock ring (44) to disengage the wear bushing (WB). A dead band between the engagement sleeve (40) and running nut (36) prevents accidental release of the running tool (RT) from the wear bushing (WB), and, on further rotation, the running nut (36) becomes a driving element for piece (20) of the wear bushing (WB) and for threading packoff drive nut (32) of the packoff assembly (P) so as to set the packoff. During rotation, the packoff nut (32) becomes disengaged from piece (16) of the wear bushing (WB).

The apparatus is characterized by not having the lock ring (42) engage the casing hanger (C) and in that one running tool is usable with several sizes of casing hangers.

26 Claims, 8 Drawing Figures

Fig. 1.
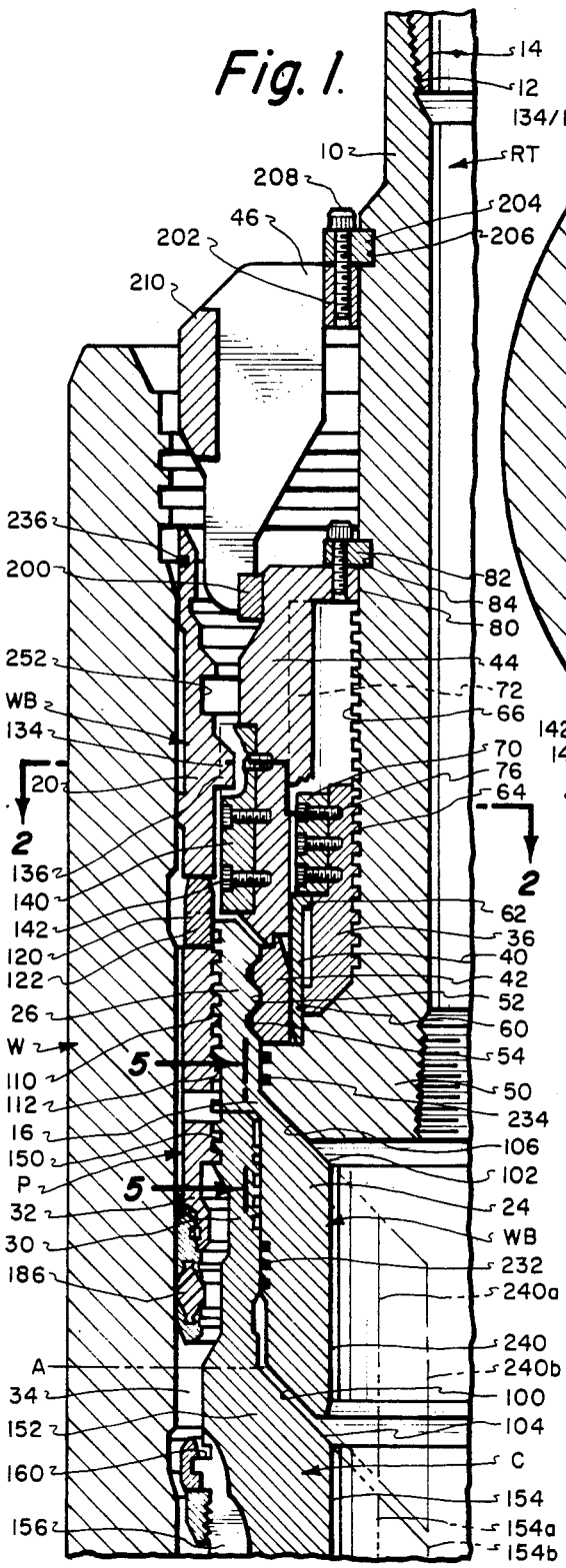
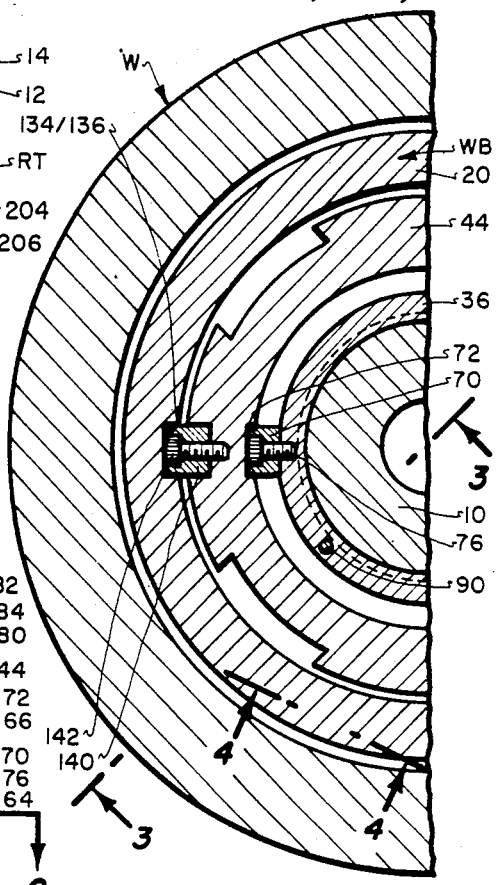
Fig. 2.
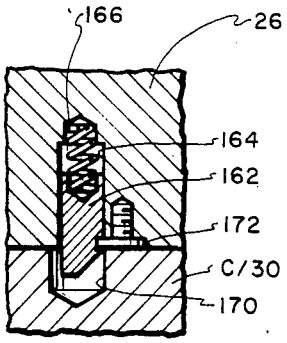
Fig. 5.

Fig. 3.
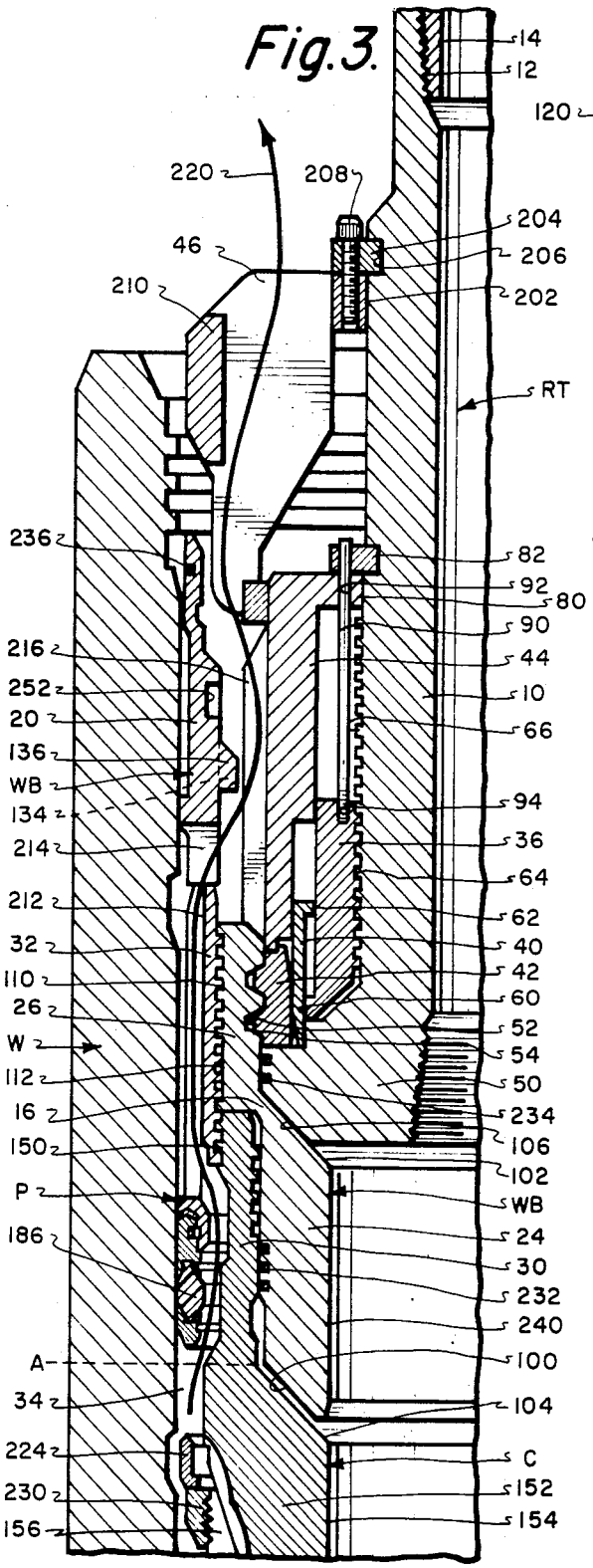
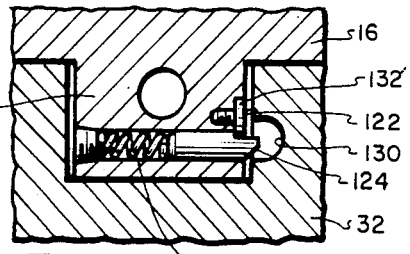
Fig. 4.
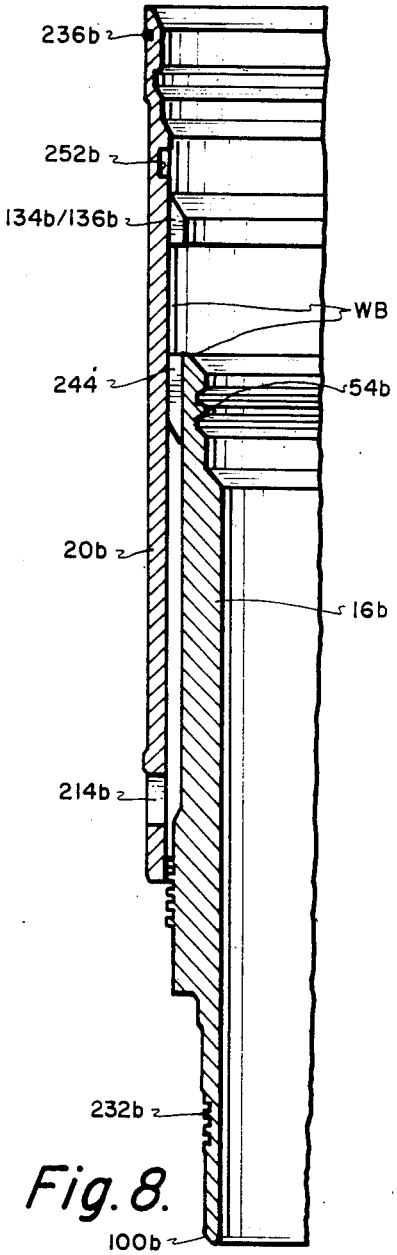
Fig. 8.

CASING HANGER RUNNING TOOL

BACKGROUND OF THE INVENTION

The present invention relates, in general, to subsea well apparatus and is directed specifically to subsea well apparatus such that, in only one trip between the vessel or platform on the water surface and the subsea well, a casing string is run into the well bore and cemented in place, a wear bushing is positioned within the well bore for protecting the surrounding wellhead during subsequent drilling operations, and the annular seal region between a casing hanger body and the surrounding wellhead bore is sealed and tested.

More specifically, in the drilling of oil and gas wells at an underwater location, a casing string is run into a well bore, and supported by a casing hanger (also referred to as hanger body) resting on complementary seats within a surrounding wellhead. After the casing string is cemented in place, a suitable seal assembly, referred to as a packoff assembly, is actuated (energized) to packoff (seal) the annular seal region (gland) between the exterior of the casing hanger and the surrounding wellhead for later drilling operations to take place within the wellhead. Energizing the packoff (seal) is also referred to as setting the packoff. Apparatus for such operations is illustrated in a number of U.S. patents, such as, for example, U.S. Pat. Nos. 3,313,030, 3,468,558, 3,468,559, 3,489,436, 3,492,026, 3,797,864 and 3,871,449. These patents show examples of casing hangers (hanger bodies), packoff assemblies with deformable elastomeric packing seals (packoffs), and seat protectors (now called wear bushings depending on their function, although in these patents, the terms were used interchangeably), being lowered into position in one trip of the running tool between the vessel or platform and the well.

Reference is also made to the U.S. patent application of Goris and Pettit, Ser. No. 719,383, filed Apr. 2, 1985 entitled "Casing Hanger and Running Apparatus", which disclosed apparatus in which seating the casing hanger within the wellhead, cementing the casing hanger in place, packing off the seal region and pressure testing off the seal for leakage is accomplished in one trip between the vessel or platform and the well. However, no wear bushing is disclosed in this referenced application.

Another U.S. patent application of John Pettit entitled "Casing Hanger Running Tool", Ser. No. 727,491, filed Apr. 26, 1985 discloses a running tool which, among other things, will position a casing hanger and a wear bushing in one trip with the wear bushing positioned in its final position upon the landing of the running tool in the wellhead.

This invention improves such apparatus by having a running tool engage one piece of a two piece wear bushing instead of engaging the casing hanger as in the prior art apparatus. The engaged piece supports a packoff drive nut of a packoff assembly which, in turn, supports a casing hanger. The other piece of the wear bushing is used to drive the packoff assembly to seal an annular seal region between the casing hanger and surrounding well bore. With this arrangement, one running tool is usable with varying sizes of casing hangers.

This invention also includes means by which the running tool can be released rapidly prior to moving the seal into the annular seal region and means by which an engaged piece of the wear bushing is positioned in its final operating position when the apparatus is initially landed in the well bore. Also included in the means for rapid release of the running tool is means for releasing the drive elements of the running tool upon application of low torque and a safety feature to prevent accidental release of the running tool.

SUMMARY OF THE INVENTION

This invention includes a running tool comprising a stem with a torque ring, a running nut, an engagement sleeve, and a lock ring, which together releasably connect and support a casing hanger, a two piece wear bushing, and packoff assembly thereon. The stem supports the lock ring which is externally profiled to engage complementary profiles on the first (inner) piece (referred to above as the engaged piece) of the wear bushing and is urged into engagement therewith by axial movement of the running nut upon rotation of the stem. The packoff drive nut of a packoff assembly, being threaded on external threads on the top of the casing hanger, supports the latter and is keyed to the second (outer) piece of the wear bushing for rotational movement therewith. The outer piece of the wear bushing is likewise keyed to the torque ring so that rotation of the torque ring also rotates the outer piece and the packoff assembly while the inner piece of the wear bushing remains stationary. In the process of rotating, the packoff nut becomes disengaged from the inner piece of the wear bushing.

Thus, this invention differentiates over all other such apparatus in that running tool engages one (inner) piece of the wear bushing which supports the packoff drive nut, the packoff drive nut, in turn, supports the casing hanger, and the other (outer) piece of the wear bushing drives the packoff assembly on rotation of the running tool.

The casing hanger, wear bushing and packoff assembly are lowered together into position within the wellhead on the running tool. In its initial landed position, the inner piece of the wear bushing is positioned without further movement being required. A flowby path is available during the circulating and cementing operations. After cementing has been completed, the running tool is released by rotation of the stem, which raises the running nut, disengages the engagement sleeve from the expanded lock ring and allows the lock ring to retract and disengage the inner piece of the wear bushing. Continued rotation raises the running nut to its upper most position where it becomes a driving element to rotate the torque ring and outer piece of the wear bushing to thread the packoff assembly downwardly off of the inner part of the wear bushing and into the annular seal region between the exterior of the casing hanger and the surrounding wellhead and to energize the packoff seal portion thereof to seal the annular seal region. The running nut is threaded on the stem with a thread having a significantly high angle thread lead (helix) of 10° to 15° for rapid axial movement so that the running nut will not jam when transmitting high torque. A dead band area between the engagement sleeve and running nut allows considerable amount of axial movement of the running nut before disengagement of the engagement sleeve from the lock ring as a safety feature against accidental disengagement of the running tool.

It will be apparent to those skilled in the art after a review of the drawings and the Detailed Description that in the arrangement of this invention:

(1) the same running tool may be used for various sizes of casing hangers without modification;

(2) the diameter of the inner bore (ID) of the inner piece of the wear bushing and the inner bore (ID) of the casing hanger are substantially the same so that wear of one or the other will not differ significantly during subsequent operations in the well:

(3) the high angle threads on the running nut and stem are effectively a releasable thread which allows high torque to be applied to the running nut in its driving position, but also allows the running nut to be backed off from its driving position with much less torque being applied to facilitate preparing the running tool for reuse; and (4) the running tool is capable of being released, if desired, even through the packoff assembly has not been placed in proper sealing position, for whatever reason, to allow the running tool to be retrieved.

BRIEF DESCRIPTION OF THE DRAWINGS

FIG. 1 is an elevational view, in cross-section, illustrating the subsea well apparatus of this invention;

FIG. 2 is a cross-sectional view taken along line 2—2 of FIG. 1;

FIG. 3 is an elevational view, in cross-section, like FIG. 1, but taken along line 3—3 of FIG. 2;

FIG. 4 is an enlarged partial view taken along line 4—4 of FIG. 2 illustrating the releasable torque key connection between the packoff nut and wear bushing;

FIG. 5 is an enlarged partial view taken along line 5—5 of FIG. 1 showing the anti-rotation pin between the wear bushing and casing hanger;

FIG. 8 illustrates a longer version of the wear bushing.

DETAILED DESCRIPTION

Figure 6:
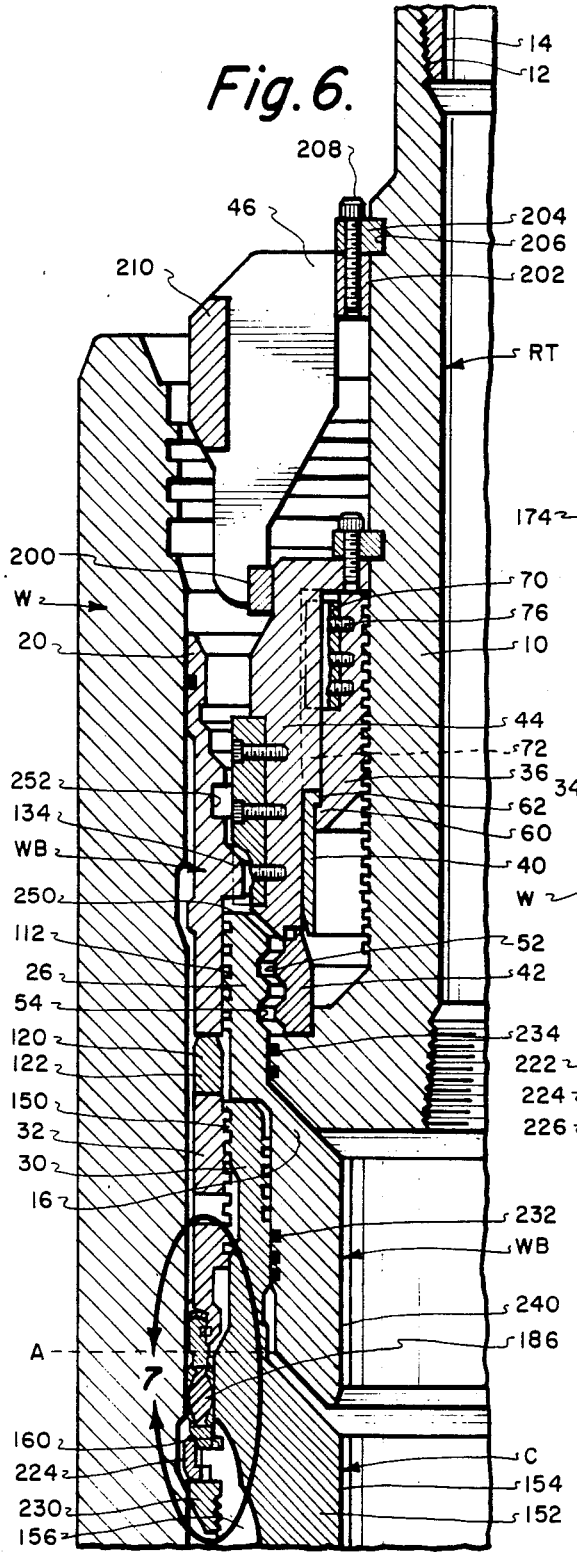
FIG. 6 is an elevational view, in cross-section, like FIG. 1, but showing the packoff set.

In the drawings, the invention is depicted already landed in the wellhead housing W with a casing hanger C shown supported on a suitable outwardly facing seat or shoulder (not shown) in the bore of the wellhead housing W. The casing hanger C, two piece wear bushing WB, and a packoff assembly P were assembled (made up) on a stem 10 of a running tool RT, while on the vessel or platform, and were lowered from the vessel or platform to the wellhead housing W by having the running tool stem 10 connected by a tapered thread connection 12 to the lower one of a string of tubing, such as drill pipe 14. The wear bushing WB comprises two pieces, a lower inner piece 16 and an upper outer piece 20 and as shown, a lower cylindrical section 24 of the inner piece 16 of the wear bushing WB is almost entirely nested in the casing hanger C and a second, thinner, upper cylindrical section 26 is seated on the top section 30 of the casing hanger C with the outer diameter of the upper section 26 the same as the outer diameter of the top section 30. The top section 30 of the casing hanger C and the upper section 26 are threaded on a packoff drive nut 32 of the packoff assembly P and, thus, are both supported by the packoff drive nut 32. Since the packoff drive nut 32 also supports the casing hanger C, when the apparatus is run into the wellhead W, it is also referred to as a running nut.

In the position shown, circulating and cementing operations can be conducted in the usual manner. After completion of the cementing operation, the annular seal space (gland) 34, between the cylindrical inner wall or bore of the wellhead housing W and the opposing cylindrical wall of the casing hanger C, is sealed by the packoff assembly P. This is accomplished by rotation of the outer piece 20 of the wear bushing WB driving the packoff assembly P into the annular seal space 34.

The running tool RT comprises the following components: the stem 10—a running nut 36, an engagement sleeve 40 and a lock ring 42; and near the middle and upper end of the stem—a torque ring 44 and stabilizing fins 46. The running tool RT with its attendant components are retrievable as will be understood from the description hereinafter.

The lower end of the stem 10 is also formed with an upset 50 (enlarged radial extension) which supports the lock ring 42. The lock ring 42 is provided with an external latching profile 52 for engaging a complementary internal latching profile 54 on the inner bore of the upper section 26 of the inner piece of the wear bushing WB. The lock ring 42 is a split ring, biased out of engagement with the profile 54, but is forced radially outwardly into engagement with the profile 54 by the engagement sleeve 40. This lock ring 42, when in engagement with the profile 54, enables the two pieces of the wear bushing WB and the packoff assembly P to be supported on the stem 10. The packoff assembly P, in turn, supports the casing hanger C. Retraction of the lock ring 42, on the other hand, not only permits initial assembly of the wear bushing WB and the equipment it supports on the running tool RT, but also allows disengagement of the running tool RT for retrieval at the appropriate time. FIG. 6 shows the position of the outer diameter of the lock ring 42, in its collapsed position, so as to allow retrieval of the running tool RT. The inner upper edge of the lock ring 42 and the lower end of the engagement sleeve are formed to facilitate their engagement.

The engagement sleeve 40 is a ring which rotates freely on the outer periphery of the stem 10 and is moved in and out of engagement with the lock ring 42, i.e., moved axially of the stem 10, by the running nut 36. The running nut 36 is an elongated sleeve with its lower end telescoped within the engagement sleeve 40 and, at its upper end, is provided with a radially outwardly extending rim 60 which is engagable with a radially inwardly extending rim 62 at the top of the engagement sleeve 40. The running nut 36 has internal threads 64 which engage complementary external threads 66 formed on the outer periphery of the stem 10 so that rotation of the stem 10 will also move the running nut 36 axially of the stem 10. The running nut 36 also has external keys 70 (one shown) which engage axial internal key slots 72 (also only one shown) on the torque ring 44 so that in one position, the running nut 36 may drive the torque ring 44 yet, in another position, move the running nut 36 axially relative to the torque ring 44. The keys 70 are fastened in grooves in the running nut 36 by bolts 76. Keys 70 are also the means which engage the top rim 62 of the engagement ring 40 to drive the latter behind the lock ring 42, as shown in FIG. 1.

The torque ring 44 is cylindrical with an inner bore spaced from the periphery of the stem 10 a distance sufficient to accommodate the running nut 36 and engagement sleeve 40 throughout most of its length and loosely engages the stem 10 by a radially inwardly directed flange 80. A split ring 82 bolted to the flange 80, and positioned within a groove 84 in the stem, prevents axial movement of the torque ring 44 relative to the stem 10. During assembly of the casing hanger C, two piece wear bushing WB and packoff assembly P on the running tool RT, this torque ring 44 is held stationary with respect to the casing hanger so that rotation of the stem 10 will thread the running nut 36 axially of the stem 10. Thus, rotation of the stem 10 to the left, i.e., counter clockwise, as viewed from the vessel or platform, will move the running nut 36 downwardly so that the running nut 36 will move the engagement ring 40 behind the lock ring 42 urging the external latching profile 52 into engagement with the internal latching profile 54. This is the position of the components in FIG. 1. As shown in FIG. 3, the torque ring 44 is provided with a position indicator in the form of a rod 90 located in a bore 92 in the flange 80. The rod 90 engages a threaded hole 94 on the running nut 36 and provides an indication that the lock ring 42 is fully engaged in the wear bushing profile.

The two sections 24 and 26 of the inner piece of the wear bushing WB form a bell-shaped body. As mentioned before, the lower section 24 is thicker than the upper section 26 and has a lower tapered surface 100 and an upper internal tapered surface 102 near the thinner upper section 26. Both tapered surfaces are generally parallel. The tapered surface 100 cooperates with a similarly tapered surface 104 on the casing hanger C and the upper tapered surface 102 cooperates with a tapered surface 106 on the upset 50 of the stem 10. The upper and lower sections 24 and 26 are also offset to receive the top section 30 of the casing hanger C in telescoping relationship. The upper section 26 is also provided with external threads 110 which threadably engage complementary internal threads 112 on the packoff drive nut 32.

The outer piece 16 of the wear bushing WB is an elongated sleeve which is slideable within the bore of the wellhead housing W and, as shown in FIGS. 1, 4 and 6, is provided with a plurality of downwardly extending torque keys 120 (lugs) which extend into complementary slots 122 in the top end of the packoff drive nut 32. By reason of this arrangement, rotation of the upper piece 16 will rotate the packoff drive nut 32. Within the torque keys 120 are frangible shear pins 124 biased outwardly by helical springs 126 into recesses 130 in the packoff drive nut 32. The shear pins 124 are held in place by a retainer 132. The torque keys 120, engaging the recesses 130, cause the upper piece of the wear bushing WB to follow the packoff nut as it is moved downward by action of the right hand threads, yet will shear when the wear bushing is to be retrieved.

The upper piece 16 of the wear bushing WB is also provided with internal axial key slots 134 formed in an internal rim 136 to receive elongated keys 140 (FIG. 2) positioned on the outer periphery of the torque ring 44. These keys 140 are located in a groove in the torque ring 44 and are fastened thereto by a plurality of bolts 142.

The lower end of the internal threads 112 on the packoff drive nut 32 which threadably engage complementary external threads 110 on the upper section 26 of the inner piece of the wear bushing WB also threadably engage external threads 150 on the top section 30 of the casing hanger C.

The depicted casing hanger C is typical and comprises a main body section 152 integral with the upper section 30 and provided with a cylindrical inner bore 154 and circulating passages 156 and a packoff actuating shoulder 160. As stated above, the external threads 150, located externally of the upper thin section 30 and shown in threaded engagement with internal threads 112 on the packoff drive nut 32, are right handed so that a right hand rotation of the upper piece of the wear bushing will lower the packoff drive nut 32 into the gland. As more clearly shown in FIG. 5, to prevent relative rotation between the casing hanger C and the inner piece 14 of the wear bushing WB, anti-rotation devices are provided. Each device is a pin 162 located in a vertical recess 164 in the lower edge of the upper section 26 and is biased by a helical spring 166 into a blind bore 170 in the very top edge of the thin section 30 of the casing hanger C. A retainer 172 holds the pin 162 and spring 166 within the recess 164.

Thus, as mentioned previously, counter clockwise rotation of the stem 10 will move the running nut 36 axially downwardly behind the engagement sleeve 40 to urge the lock ring 42 outwardly and into engagement with the upper section 26 of the inner piece of the wear bushing. Clockwise rotation of the stem 10, on the other hand, will thread the running nut 36 upwardly so that its rim 60 will eventually engage the rim 62 of the engagement sleeve 40 pulling the engagement sleeve 40 upwardly out of engagement with the lock ring 42, allowing the lock ring to release from the lower section 26 of the wear bushing. The dead band, or free axial movement of the running nut 36 upwardly for some distance before running nut rim 60 engages the rim 62, provides a safety factor against accidental release of the running tool for the casing hanger. Also, the key slots 72 on the torque ring 44, together with the high lead threads on the running nut 36 and stem 10, provide a rapid transport and thus rapid release of the running tool from the inner piece 14 of the wear bushing WB. The continued rotation of the stem 10 and continued upward movement of the running nut 36 will cause the top end of the keys 70 in the running nut 36 to engage the flange 80 on the torque ring 44. Since further rotation is prevented when the running nut 36 is in this position, the running nut 36 becomes a driving element whereby continued rotation of the stem 10 will drive the torque ring 44 to ultimately transmit rotational movement to the packoff drive nut 32. It is also pointed out that due to the high pitch of the threads, the running nut 36 will not be tightly engaged in its position against the flange 80 so that the running nut 36 can be easily broken out for further use of the running tool despite the high torque applied through the running nut 36 to set the packoff seal.

Figure 7:
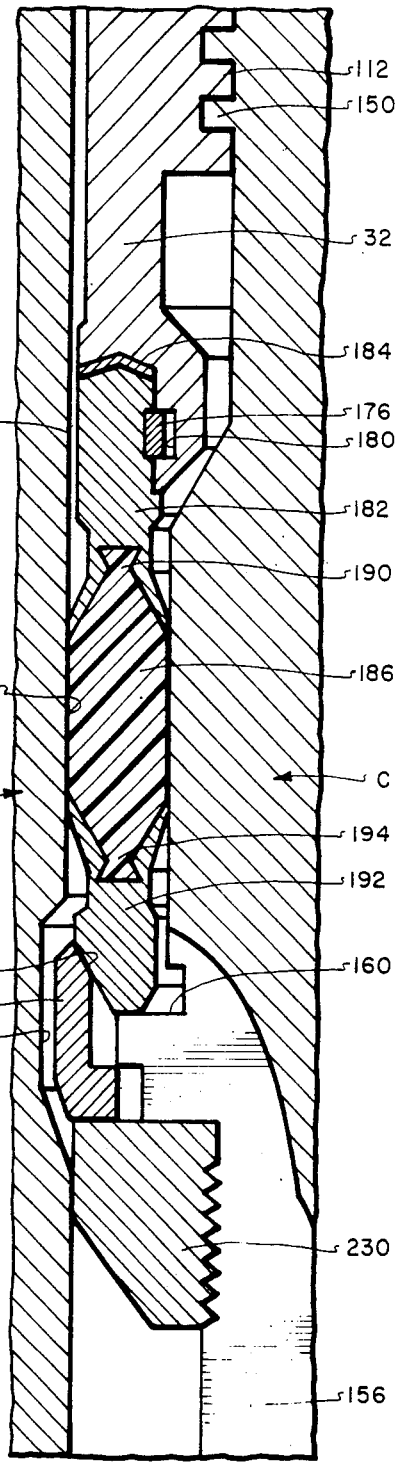
FIG. 7 is an enlarged view of the packoff in the area of the arrow in FIG. 6.

The packoff assembly P, as more clearly shown in FIG. 7, includes the packoff drive nut 32 and a packoff seal portion 174 connected to the packoff drive nut 32. The packoff seal portion is conventional, and more fully described in the U.S. Pat. No. 3,797,874, and in the U.S. patent application No. 4,521,040, it can be seen to include a swivel connection accomplished by a split retainer 176 ring mounted in a complementary grooves 180 in a support ring 182 and in the packoff drive nut 32. A thrust bearing 184 between the packoff drive nut 32 and the support ring 182 permits rotation of the packoff drive nut 32 without rotating the support ring 182. In the embodiment disclosed, the lower end of the support ring 182 engages and supports the upper end of a cylindrical resiliently deformable packing ring 186 by a dovetail connection 190. A lower abutment ring 192 is connected to the packing ring 186 by a dovetail connection 194.

Attention is now directed to FIGS. 1, 3 and 6 and to the top of the torque ring 44 and running tool stem 10.

The centralizer fins 46 are radially outwardly extending, relatively thin plates, each fixed, as by welding, at its lower end to a retainer ring 200 which surrounds and engages the torque ring 44. The upper end of the plates are each provided with a second retainer ring 202, attached as by welding thereto, surrounding and engaging the stem 10. Ring 202 is similar to ring 200, but has a split ring 204 seated in a groove 206 in the stem 10. Split ring 204 is attached to ring 202 by bolts 208. The ring/bolt assembly 202/208 attach the centralizer fins 46 to the torque ring 44 and stem 10. The centralizer fins 46 are L-shaped in elevation and extend radially outwardly to engage the inside surface of the wellhead housing 10 and serve to centralize the running tool within the wellhead housing W, as well as to act as a bushing between the stem 10 and the wellhead housing bore. A support ring 210 surrounds the fins 46 to provide a circular surface where the centralizer contacts the housing bore.

From the foregoing explanation and, as more clearly shown in FIG. 3, it can be seen that for circulating and cementing operations, there is a flowby through the passages 156 in the casing hanger, the annular seal area or gland 34, the passages 212 in the packoff drive nut 32, through ports 214 in the lower end of the outer piece 20 of the wear bushing, through axial slots 216 on the torque ring (see also FIG. 2 for slots 216) and out through the spaces between the centralizer fins 46. This flow is represented by the arrow 220 in FIG. 3.

Again, after the circulating and cementing operations, clockwise rotation of the stem 10 will first cause upward movement of the running nut 36 on the threads 66 and, afterward, a downward movement of the packoff assembly P by reason of rotation of the running nut 36, torque ring 44 and outer piece 20 of the wear bushing. Continued rotation of the stem 10 will cause the packoff drive nut 32 to drive the seal assembly downward free and clear of the threads 110 on the upper section 26 of the inner piece of the wear bushing and into engagement with the shoulder 160 on the casing hanger and to expand the elastomeric seal 186, thus sealing the annular seal area 34 against leakage. This is depicted in FIG. 7. The lower abutment ring 192 also engages a conical surface 222 on a split ring 224 to urge the latter into a groove 224 in the wellhead housing W to lock the casing hanger C within the well bore. The split ring 224 is supported on a ring 230 threaded on the casing hanger C.

It should be noted that as the outer piece 20 of the wear bushing WB is rotated downward, relative to the inner piece 16, the flowby ports 214 become blanked off by the top of the inner piece. This prevents debris and cuttings from accumulating on the bore of the wellhead.

At this time, the efficacy of the seal of the set packoff 186 is tested by pressurizing the area above the running tool, etc. The O-ring seals 232 between the casing hanger C and section 24 of the inner piece 16 of the wear bushing (three seals shown) and O-ring seals 234 between the thin section 26 of the inner piece 16 and the upset 50 on the stem 10 (two shown) prevent leakage between these named components so that the seal of the set packoff can be tested.

It should be pointed out also at this time that rotation of the packoff drive nut 32 could begin before the running nut 36 reaches its uppermost position due to friction, debris, etc., causing the torque ring 44 and upper piece 20 of the wear bushing to rotate, but, in any event, as the packoff assembly P begins to set, this frictional phenomena will be overcome and the running nut 36 will continue to thread upwardly until it reaches its uppermost position engaging the flange 80 where it becomes a drive element. The ability of the running tool to be released prior to the setting of the packoff also has the advantage of retrieving the running tool in the event the packoff cannot be properly set for whatever reason.

The running nut 36, in the meantime, has freed the lock ring 42 of engagement with the inner piece 16 of the wear bushing so that the torque ring 44, running nut 36, engagement sleeve 40, and lock ring 42 are now free to be withdrawn.

As shown in the drawings, the inner bore 240 of the inner piece 16 of the wear bushing WB and the bore 154 of the casing hanger C are substantially the same so that wear during subsequent operations on the well will be distributed between the two bores. FIGS. 1 and 8 also show the universality of the running tool for different sizes of wear bushings and casing hangers. Conventionally, the casing hanger C above the main body section 152 at about line A remains the same so that the different size casing hangers differ only in diameter of the inner bore 154 of the main body section 152. In FIG. 1 two such differences in sizes of casing hangers are illustrated in phantom at **154*a* and 154*b*. Similarly, the inner piece 16 of the wear bushing WB will be made to correspond to the inner diameter of the selected casing hanger by thickening the wall of the lower section 24 and extending the tapered surfaces 100 and 102. Thus, the bore of the thickened lower section will correspond in diameter to the selected bore of the casing hanger as at 240*a* and 240*b*. No change needs to be made in the length of the tapered surface 106 on the upset 50 of the stem 10**.

FIG. 8 illustrates another configuration of the two piece wear bushing WB for larger bore casing hangers with longer wear bushings. The inner piece **16*b* and outer piece 20*b* differ in thickness and length from the previously described pieces of the wear bushing and are given the same reference numerals, but with the suffix b to denote their similar functions. This configuration, however, has additional flowby slots 244**. The running tool RT will handle this configuration of the wear bushing without modification.

The wear bushing WB may be removed by the same running tool RT in the same manner that the apparatus was originally assembled. As shown in FIG. 6, the packoff drive nut 32 is now free of the external threads 112 on the top section 26 of the inner piece 16 and the running nut 32 is threaded on the casing hanger C. Thus, a pull on the running tool RT will move the inner piece 16 upwardly, free of the casing hanger, so that its top end 250 engages the rim 134 and both pieces of the wear bushing WB will then be retrievable. At this time, since the outer piece 20 is still latched to the top of the running nut 36 by shear pins 124 (FIG. 4), the continued pull on the wear bushing will shear these pins freeing the wear bushing WB of the packoff drive nut 32.

To re-run the wear bushing WB, there are two possible methods available. One method is to lower the wear bushing WB utilizing the same running tool RT. Another method is to engage J-slots 252 on the inner bore of the outer piece 20 of the wear bushing WB with any running tool having J-slot lugs thereon. In the second method, the two pieces of the wear bushing WB must be fastened together by any suitable means, such as by bolts through the outer piece engaging threaded bores in the inner piece.

We claim:

1. An apparatus for supporting a tubular string extending into a well bore from a surrounding wellhead, comprising;

hanger body means adapted to be located in the wellhead and connected to the tubular string and having at least external threads and at least one sealing surface thereon;

wear bushing means adapted to be located in the wellhead;

packoff means adapted to be located in the wellhead;

running tool means connectable to a running string;

means releasably connecting said wear bushing means and packoff means to said running tool means to enable said hanger body means, wear bushing means, and packoff means to be lowered into said wellhead; and means for moving said packoff means downwardly of said hanger body means toward said sealing surface and effecting sealing engagement of said packoff means with said sealing surface and said surrounding wellhead without downward movement of said hanger body means;

said hanger body means being supported by said packoff means as said running tool means lowers said apparatus into said wellhead.

2. The apparatus as claimed in claim 1 wherein said packoff means supports said hanger body means and part of said wear bushing means supports said packoff means as said running tool means lowers said apparatus into said wellhead.

3. The apparatus as claimed in claim 1 wherein driving movement of said packoff means downwardly of said hanger body means disconnects the packoff means from said wear bushing means allowing retrieval of said wear bushing means free of said packoff means, if desired.

4. The apparatus as claimed in claim 1 wherein the inner bores of said hanger body means and said wear bushing means are substantially equal.

5. The apparatus as claimed in claim 1 wherein said sealing surface is a cylindrical wall spaced from an inner cylindrical wall of said wellhead, thus defining an annular seal area.

6. The apparatus as claimed in claim 1 wherein said means releasably connecting said wear bushing means and packoff means to said running tool means comprises lock ring means, engagement means, and threaded means for moving said engagement means into one position where said lock ring means is latched to said wear bushing means and to a second position where said lock ring means is unlatched from said wear bushing means to allow said running tool means to be released from said wear bushing means.

7. The apparatus as claimed in claim 1 wherein said wear bushing means comprises an inner piece and an outer piece.

8. The apparatus as claimed in claim 7 wherein said means for moving said packoff means downwardly is said outer piece.

9. The apparatus as claimed in claim 8 wherein said packoff means is attached to said outer piece.

10. The apparatus as claimed in claim 8 wherein said hanger body means is supported on said packoff means and said inner piece.

11. The apparatus as claimed in claim 6, wherein said threaded means comprises running nut means fixed to said running tool means to rotate therewith and moveable axially thereof.

12. The apparatus as claimed in claim 11 wherein said running nut means is moveable axially on said running tool means independently of said engagement means a distance before moving said engagement means into said one position by rotation of said running tool means in one direction and moveable axially independently of said engagement means while said engagement means is at said one position before moving said engagement means to said second position by rotation of said running tool means in a second direction.

13. The apparatus as claimed in claim 12 wherein said running tool is moveable still further after moving said engagement means to said second position, to a position where said running nut means becomes part of said means for moving said packoff means downwardly.

14. The apparatus as claimed in claim 13 wherein said running tool means includes stem means, a torque ring means telescoping said stem means but spaced therefrom sufficiently to allow said running nut means to pass between said stem means and said lock ring means, said stem means having external threads engageable with internal threads on said running nut means, and axial grooves on said running nut means engageable by axial grooves on said torque ring.

15. The apparatus as claimed in claim 14 wherein said packoff means is supported on said inner piece of the wear bushing means by interengaging threads on said packoff means and inner piece.

16. The apparatus as claimed in claim 15 such that, when said running nut means becomes part of said means for moving said packoff means downwardly, rotation of said stem in said second direction rotates said running nut means and wear bushing means to thread said packoff means downward on said hanger body means.

17. The apparatus as claimed in claim 16 wherein said packoff means includes a packoff nut, said packoff nut being the connection between the inner piece of the wear bushing and wherein said packoff nut becomes disconnected from said wear bushing means when threaded downward onto said hanger means.

18. The apparatus as claimed in claim 6 further including means for indicating that the lock ring means have been moved to said one position.

19. The apparatus as claimed in claim 6 wherein said threads on said running nut and said stem means are helical in the range of 10° to 15°.

20. Apparatus for supporting a tubular string extending into a well bore from a surrounding wellhead, comprising;

a casing hanger adapted to be located in the wellhead and having a sealing surface;

a wear bushing partly nestable within said casing hanger;

a packoff assembly;

a running tool connectable to a running string:

a first means releasably connecting said wear bushing to said running tool to enable said wear bushing to be lowered into the wellhead together with said casing hanger and packoff assembly;

a second means connecting said packoff assembly to said casing hanger and initially positioning said packoff assembly above sealing surface, both said first and second means being responsive to actuation by said running tool to release said wear bushing from said running tool and move said packoff assembly into engagement with said casing hanger and to effect sealing engagement of said packoff assembly with said sealing surface while said casing hanger and part of wear bushing remain axially stationary with respect to said wellhead.

21. The apparatus as claimed in claim 20 wherein said packoff assembly supports said casing hanger and part of said wear bushing supports said packoff assembly.

22. A method of lowering a casing hanger together with a wear bushing and sealing said casing hanger in a wellhead comprising the steps of:

attaching apparatus including said casing hanger, said wear bushing and a packoff assembly onto a running tool;

connecting said running tool and apparatus onto means for lowering and rotating said running tool into a wellhead located subsea;

positioning said casing hanger and wear bushing in said wellhead, said casing hanger and wear bushing being adapted for that purpose;

rotating said running tool in one direction to lower said packoff assembly with respect to said wellhead to seal said casing hanger while said casing hanger and one part of said wear bushing remain axially stationary with respect to said wellhead.

23. The method of claim 22 wherein rotation of said running tool rotates another part of said wear bushing which, in turn, lowers said packoff assembly.

24. The method as claimed in claim 23 further including the step of disconnecting the packoff assembly from said wear bushing.

25. The method as claimed in claim 23 wherein the rotation of said running tool also disconnects said packoff assembly from said wear bushing.

26. The method of claim 25 further including the step of rotating said running tool in a second direction to release said running tool from said apparatus.

* * * * *